United States Patent [19]

Veteran

[11] Patent Number: 5,039,961

[45] Date of Patent: Aug. 13, 1991

[54] COPLANAR ATTENUATOR ELEMENT HAVING TUNING STUBS

[75] Inventor: David R. Veteran, Santa Rosa, Calif.

[73] Assignee: Hewlett-Packard Company, Palo Alto, Calif.

[21] Appl. No.: 454,673

[22] Filed: Dec. 21, 1989

[51] Int. Cl.[5] ..... H01P 1/22

[52] U.S. Cl. ..... 333/81 A; 333/263; 338/216

[58] Field of Search ..... 333/81 R, 81 A, 81 B, 333/246, 263; 338/216

[56] References Cited

U.S. PATENT DOCUMENTS

| | | | |
|---|---|---|---|
| 3,227,975 | 1/1966 | Hewlett et al. | 333/81 A |
| 3,319,194 | 5/1967 | Adam | 333/81 A X |
| 3,521,201 | 7/1970 | Veteran | 333/81 A |
| 4,011,531 | 3/1977 | Gaudet | 333/81 A |
| 4,272,739 | 6/1981 | Nesses | 333/81 A |
| 4,670,723 | 6/1987 | Roland et al. | 333/81 A |

FOREIGN PATENT DOCUMENTS

| | | | |
|---|---|---|---|
| 25401 | 2/1984 | Japan | 333/81 A |
| 165502 | 9/1984 | Japan | 333/81 A |
| 160201 | 8/1985 | Japan | 333/81 A |
| 207001 | 9/1987 | Japan | 333/81 A |
| 254503 | 11/1987 | Japan | 333/81 R |

*Primary Examiner*—Eugene R. LaRoche
*Assistant Examiner*—Benny Lee
*Attorney, Agent, or Firm*—William C. Milks, III

[57] ABSTRACT

A resistive film attenuator element comprised of a dielectric-mounted resistive film distributed ladder network having tuning stubs, combined in a coplanar structure, to provide a wide band attenuator having a substantially flat frequency response over a wide range of frequencies, for example, from D.C. to 40 GHz.

20 Claims, 6 Drawing Sheets

COPLANAR ATTENUATOR ELEMENT HAVING TUNING STUBS

BACKGROUND OF THE INVENTION

This invention relates to attenuators for altering the amplitude of an electrical input signal and, more particularly, to a distributed network resistive film attenuator. Specifically, one embodiment of the invention provides a resistive film attenuator element comprised of a dielectric-mounted resistive film distributed ladder network having tuning stubs, combined in a coplanar structure, to provide an attenuator having a substantially flat frequency response over a wide range of frequencies, for example, from D.C. to 40 GHz.

A distributed network resistive film attenuator is described in U.S. Pat. No. 3,227,975 issued to Hewlett-Packard Company and entitled Fixed Coaxial Line Attenuator with Dielectric Mounted Resistive Film. This attenuator has a substantially constant attenuation over a wide range of frequencies, for example, from D.C. to 18 GHz.

Considered in more detail, U.S. Pat. No. 3,227,975 discloses a fixed coaxial attenuator comprising a dielectric plate supported within a cylindrical outer conductor between sections of a coaxial inner conductor. A rectangular sheet of resistive material having a predetermined width and a predetermined length is positioned on the dielectric plate between first and second pairs of electrodes. The first pair of electrodes provides electrical contacts between the outer conductor and the lengthwise sides of the rectangular sheet along the full length thereof. The second pair of electrodes provides electrical contacts between the sections of the coaxial inner conductor and a central portion of the lateral sides of the rectangular sheet.

Resistive film attenuators of this type suffer from several known limitations. Most importantly, in order to achieve a desired attenuation or a desired impedance throughout the operating frequency range of the attenuator, the resistive film may have to be made long in order to maintain a desired attenuation and impedance, and this may affect attenuation characteristics at higher frequencies.

Furthermore, distributed network resistive film attenuators are also incorporated into cascade attenuators of the type described in U.S. Pat. No. 3,319,194 issued to Hewlett-Packard Company and entitled Variable Attenuator Employing Internal Switching. This high frequency signal attenuator provides discrete steps of attenuation using separate attenuator elements which are all disposed in a transmission line configuration adjacent a common and continuous ground plane. An attenuator of this type obviates the need for complex mechanisms for switching both the signal and ground plane conductors of the transmission line structure and thus eliminates the introduction of unknown contact impedances in the ground plane conductor at the junctions of attenuator sections.

Considered in more detail, the step attenuator for high frequency signals disclosed in U.S. Pat. No. 3,319,194 comprises a strip line structure formed in a continuous ground plane conductor using a number of switchable sections, each including a resistive card attenuator and a straight-through conductor. Selection of either of the two signal paths is accomplished by deflecting the signal conductor from contact with one signal path to contact with the other signal path using magnetic or mechanical actuators.

In both the case of the fixed coaxial line attenuator disclosed in U.S. Pat. No. 3,227,975 and in the case of the resistive card attenuators included in the cascade attenuator disclosed in U.S. Pat No. 3,319,194, different values of attenuation in nepers may be selected by altering the length of resistive film. This is especially difficult in a cascade attenuator wherein changes in the lengths of the resistive card attenuators, vis-a-vis the lengths of the straight-through conductive elements, can adversely affect the alignment of the resistive card attenuators with the switches and degrade the quality of electrical connection when the resistive card attenuators are switched in and out of the electrical circuit.

Accordingly, U.S. Pat. No. 3,521,201, also issued to Hewlett-Packard Company and entitled Coaxial Attenuators Having at Least Two Regions of Resistive Material, discloses a distributed network resistive film attenuator having a substantially constant attenuation over a broad frequency range comprised of two aligned rectangular areas of resistive film disposed a selected distance apart on a substrate supported within an outer coaxial conductor, each area having small aligned rectangular apertures therein to provide selected values of resistivity per unit area within selected portions of the film. The resistive film areas are connected by a connecting electrode of a selected length which is less than one-half of the wavelength of the highest frequency electromagnetic wave energy being attenuated to prevent resonance. A first pair of electrodes provides electrical contacts between the outer conductor and opposite edges of both rectangular areas of resistive film, and a second pair of electrodes provides electrical contacts between sections of a coaxial inner conductor and the resistive film areas, thereby interconnecting both areas between the coaxial inner conductor sections.

U.S. Pat. No. 3,521,201 discloses that the shape and location of the apertures within the resistive film determine resistivity per unit area of the film. By providing aligned equally-spaced rectangular apertures of different length and width dimensions, the resistivity per unit area can be varied along a selected direction in the plane of the resistive film. The portions of the resistive films having square apertures provide in effect a series resistance between inner conductor sections, while the portions of the resistive films having rectangular apertures therein provide in effect a shunt resistance between the central portion of the resistive films and outer conductor. Other patterns of apertures may be used to provide logarithmic or exponential or other desired variations with length in the resistivity per unit area of the resistive film. The disclosed apertures are rectangular holes and square holes disposed in a grid pattern on a substrate, but, in general, these apertures may have any shape or be arranged in any suitable pattern which provides the required resistivity per unit area of the resistive films. The desired values of resistivity per unit area in these portions of the resistive films may thus be obtained by selectively varying the size, shape, and spacing of the apertures. It is readily apparent that this technique to provide the desired resistivity per unit area is quite complex.

Also, U.S. Pat. No. 3,521,201 discloses that the length of the connecting electrode is selected for greatest linearity of attenuation with frequency over a broad frequency range from D.C. to about 18 GHz. Specifically, the connecting electrode is not longer than one-half of a wavelength at the highest operating frequency of the attenuator. Signal delay along the length of the connecting electrode between the two, otherwise isolated, resistive sheets improves the linearity with frequency of the attenuation at frequencies from about 12.4 GHz to about 18 GHz. It is readily apparent that fabrication of the two resistive film areas connected by a connecting electrode also adds to manufacturing complexity.

In view of the structural complexity of the type of resistive film attenuator disclosed in U.S. Pat. No. 3,521,201, the structure of resistive film attenuators has evolved to the configuration shown in FIG. 1. The resistive film attenuator shown in FIG. 1 comprises a resistive film distributed ladder network having resistive film 1 patterned on a dielectric material 2. The respective ends of the series resistive film portions 1A are connected to respective contacts 4 that interconnect to respective inner coaxial contacts, and the shunt resistive film portions 1B are connected to respective contacts 3 that interconnect to a coaxial outer conductor or opposing walls of a ground plane housing. Unfortunately, the flatness of the frequency response of this resistive film attenuator is controlled by changing the separation of the contacts 4. As in the case of the resistive film attenuator disclosed in U.S. Pat. No. 3,319,194, however, this is especially difficult in a cascade attenuator wherein changes in the lengths of the resistive card attenuators, vis-a-vis the lengths of the straight-through conductive elements, can adversely affect the alignment of the resistive card attenuators with the stitches and degrade the quality of electrical connection when the resistive card attenuators are switched in and out of the electrical circuit. Accordingly, there is a need for an economical, easily manufactured resistive film attenuator which has readily controllable values of attenuation and flat frequency response over a broad range of frequencies.

SUMMARY OF THE INVENTION

One embodiment of the present invention provides a resistive film attenuator element comprised of a dielectric-mounted resistive film distributed ladder network having tuning stubs, combined in a coplanar structure. The tuning stubs can be formed from either resistive film or conductive material.

The resistive film attenuator element in accordance with the invention comprises a resistive film distributed ladder network having resistive film patterned on a dielectric substrate. The respective ends of the series resistive film portions are connected to respective contacts that are connectable between respective inner coaxial contacts in a fixed coaxial line attenuator or cascade attenuator. The shunt resistive film portions are connected to respective contacts that are connectable between a coaxial outer conductor of a fixed coaxial line attenuator or opposing walls of a ground plane housing of a cascade attenuator. The tuning stubs are disposed intermediate the shunt resistive film portions. The tuning stubs are connected at one end to the respective contacts to which the shunt resistive film portions are connected and extend toward the respective series resistive film portions.

The frequency response of the attenuator element in accordance with the invention is adjusted by varying the length of the tuning stubs. A cascade attenuator in accordance with one embodiment of the invention provides a step attenuator having a substantially flat frequency response over a wide range of frequencies, for example, from D.C. to 40 GHz.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings. In the drawings:

FIG. 5, comprising

DETAILED DESCRIPTION OF THE PREFERRED EMBODIMENTS

Figure 2:
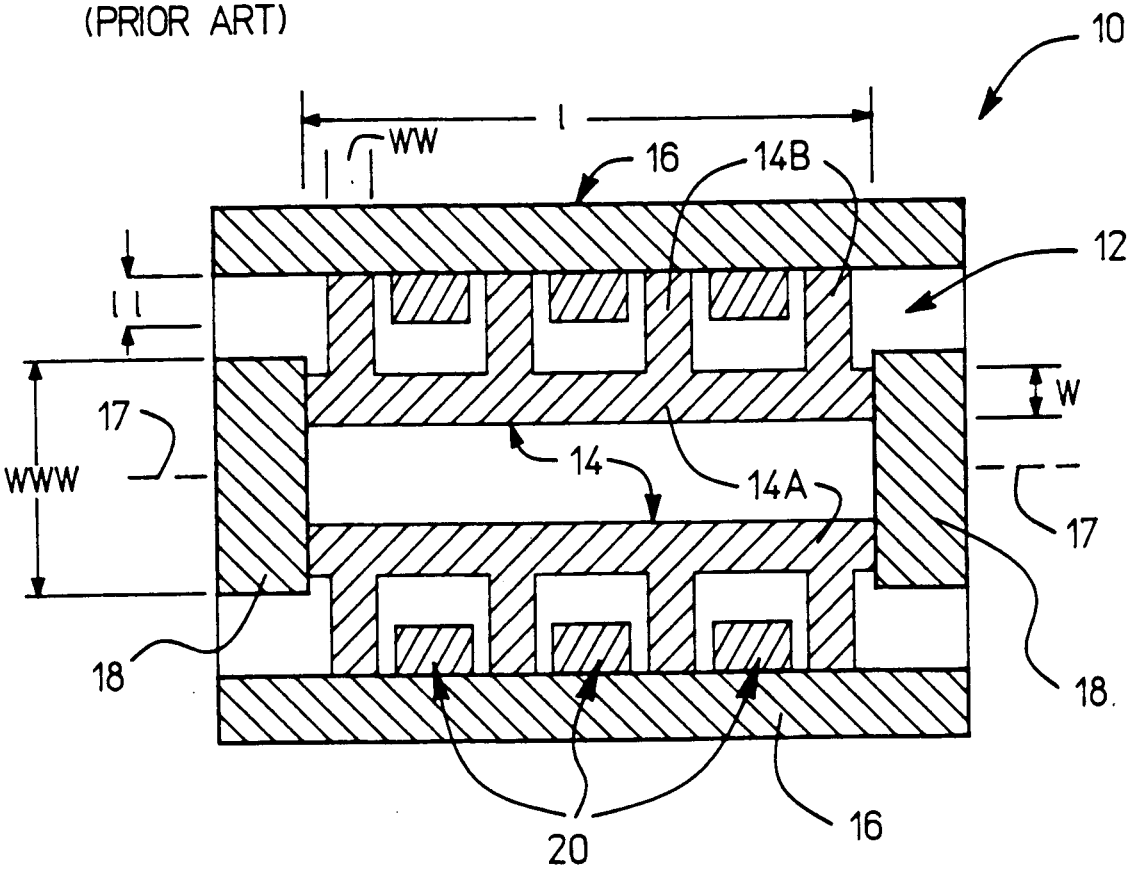
FIG. 2 shows one embodiment of an attenuator element in accordance with the invention comprised of a dielectric-mounted resistive film distributed ladder network having tuning stubs, combined in a coplanar structure.

One embodiment of a distributed network resistive film attenuator element, generally indicated by the numeral 10, is shown in FIG. 2. The attenuator element 10 comprises a dielectric substrate 12. The dielectric substrate 12, which may be sapphire, is preferably rectangular and has a substantially flat surface.

Figure 1:
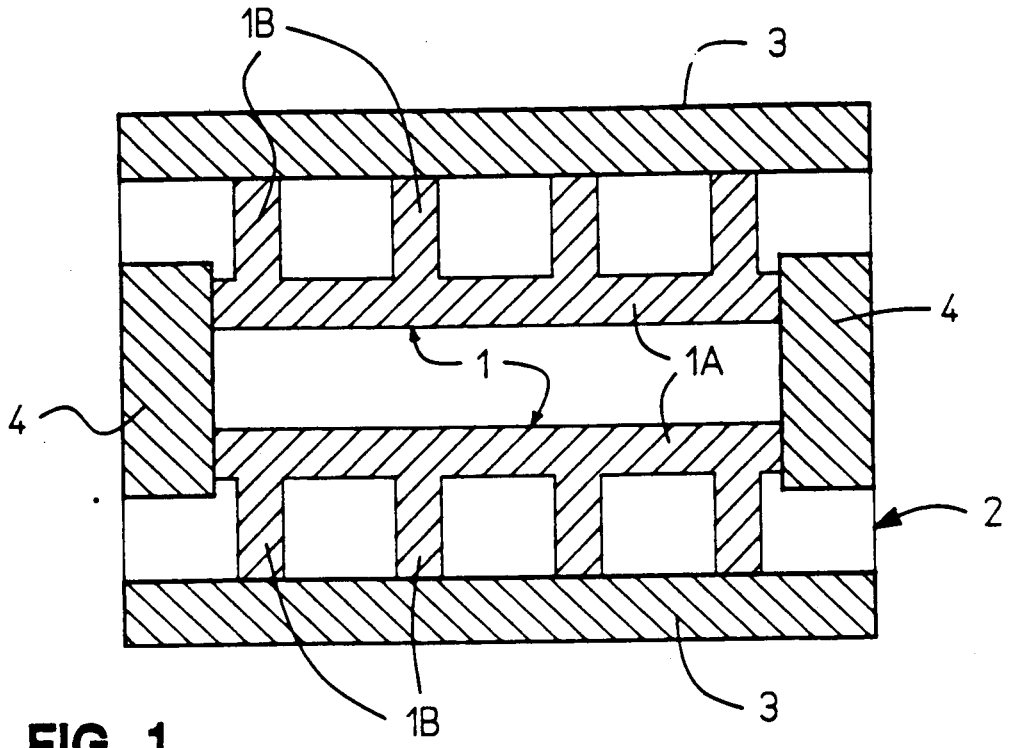
FIG 1 (PRIOR ART)
FIG. 1 shows a known dielectric-mounted resistive film distributed ladder network attenuator.

Still referring to FIG. 2, the attenuator element 10 further comprises a resistive film 14 on the dielectric substrate 12. The resistive film 14 is provided on the surface of the dielectric substrate 12 in spaced relationship along an axis 17. A distributed element attenuation ladder network is provided by configuring the resistive film 14 on the dielectric substrate 12 in the conventional pattern described earlier in conjunction with FIG. 1.

The resistive film 14 may be selectively deposited on the dielectric substrate 12 in the indicated pattern. Alternatively, the indicated pattern may be etched into a continuous deposited film. Preferably, the resistive film 14 may be formed of a metal, such as tantalum nitride, on the surface of the dielectric substrate 12 using known thin or thick film techniques.

A nominal value of attenuation is provided by selecting an appropriate length "l" of series portions 14A of the resistive film 14. Because the resistivity of the resistive film 14 then varies proportionally with the ratio of the width "w" of series portions 14A to the width "ww" of shunt portions 14B thereof, the resistivity may be adjusted by varying the ratio of the widths "w" and "ww" of the resistive film deposited to provide an exact desired attenuation value. However, the widths "w" and "ww" also affect the impedance of the attenuator element 10 when it is incorporated into a fixed coaxial line attenuator or cascade attenuator, and, accordingly, the widths "w" and "ww" may also be further adjusted by an equal percentage amount to provide a desired impedance, for example, 50 ohms.

The resistive film 14 is contiguously interposed between two pairs of highly conductive electrodes 16 and 18 provided on the surface of the dielectric substrate 12. The outboard longitudinal edges of the shunt portions 14B of the resistive film 14 are disposed in electrical contact with the pair of conductive electrodes 16. The pair of conductive electrodes 18 is disposed along the axis 17 and has a width "www." The second pair of conductive electrodes 18 is in electrical connection with the outboard lateral edges of the series portions 14A of the resistive film 14. The conductive electrodes 16 and 18 may be formed by deposition of a thin layer of a conductive metal, such as gold, on the dielectric substrate 12 prior to deposition in contact therewith of the metal which preferably forms the resistive film 14.

The attenuator element 10 further comprises tuning stubs 20. The tuning stubs 20 are disposed on the surface of the dielectric substrate 12 intermediate the shunt portions 14B of the resistive film 14. The tuning stubs 20 are connected at one end to the conductive electrodes 16 to which the shunt portions 14B of the resistive film 14 are connected and extend toward the respective series resistive film portions 14B of the resistive film. The frequency response of the attenuator element 10 is adjusted by varying the length "11" of the tuning stubs 20. The tuning stubs 20 are selectively deposited on the dielectric substrate 12. Thereafter, adjustment of the length of the tuning stubs 20 can be achieved by scratching away the deposited material with a diamond scribe, for example.

The tuning stubs 20 can be formed from the same material as the resistive film 14, such as tantalum nitride. Alternatively, the tuning stubs 20 can be formed from a thin layer of a conductive metal, such as gold, on the dielectric substrate 12 as extensions of the conductive electrodes 16.

Figure 3:
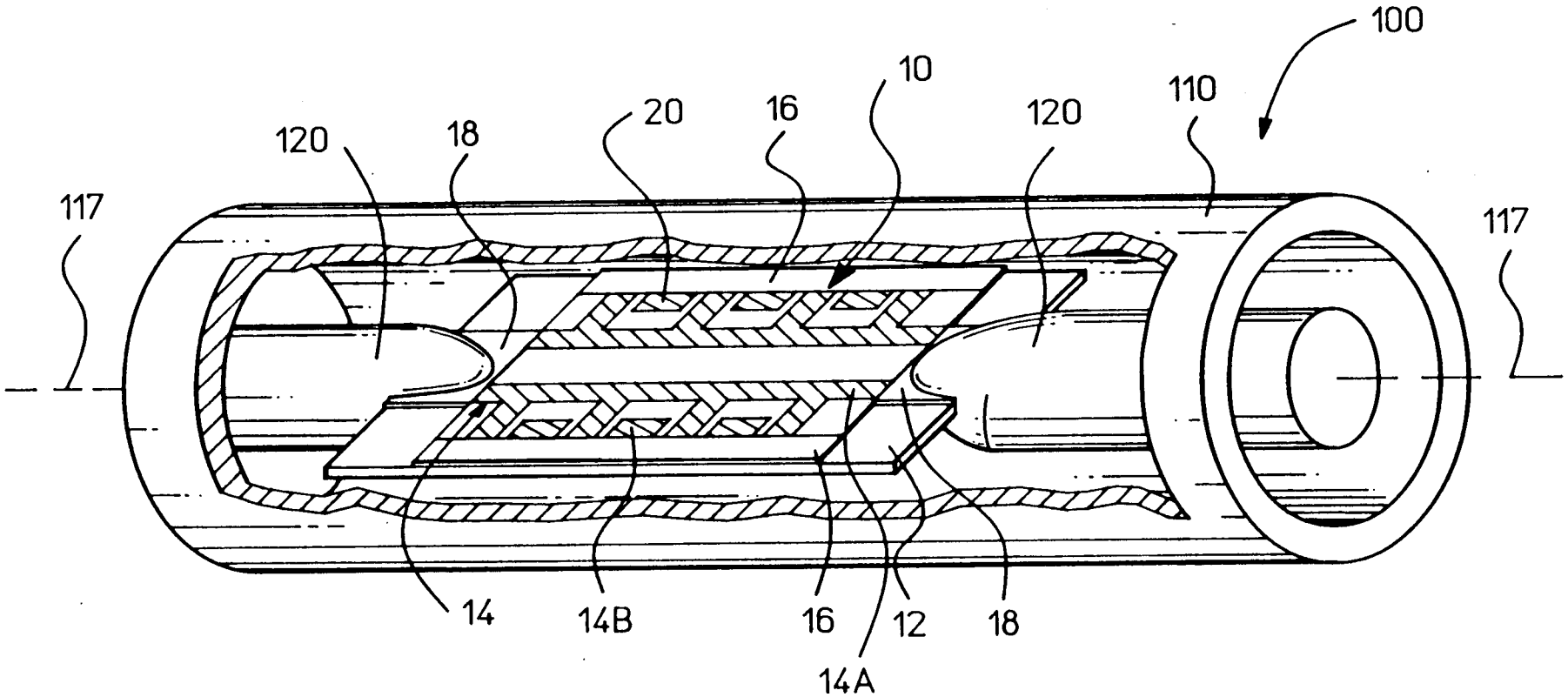
FIG. 3 shows a fixed coaxial line attenuator incorporating the attenuator element shown in FIG. 2.

The attenuator element 10 in accordance with the invention can be incorporated into a fixed coaxial line attenuator, as shown in FIG. 3. Referring now to FIG. 3, there is shown a fixed coaxial attenuator 100 comprising a cylindrical outer conductor 110 with the attenuator element 10 supported therein. The dielectric substrate 12 is sufficiently wide so that the lengthwise edges thereof are contiguous with substantially diametrically opposed portions on the outer conductor 110. The axis 17 (see FIG. 1) of the dielectric substrate 12 is aligned with the central axis 117 of the sections of coaxial inner conductor 120.

The conductive electrodes 16 are disposed between the outer conductor 110 and the outboard longitudinal edges of the shunt portions 14B of the resistive film 14 along the full length thereof to provide a good electrical signal connection between the resistive film and outer conductor 110. The conductive electrodes 18 are disposed between the sections of coaxial inner conductor 120 and central portions of the outboard lateral edges of the series portions 14A of the resistive film 14 to provide a good electrical signal connection between these central portions and the sections of the coaxial inner conductor for forming a continuous conductive path between inner conductor sections 120.

Figure 4:
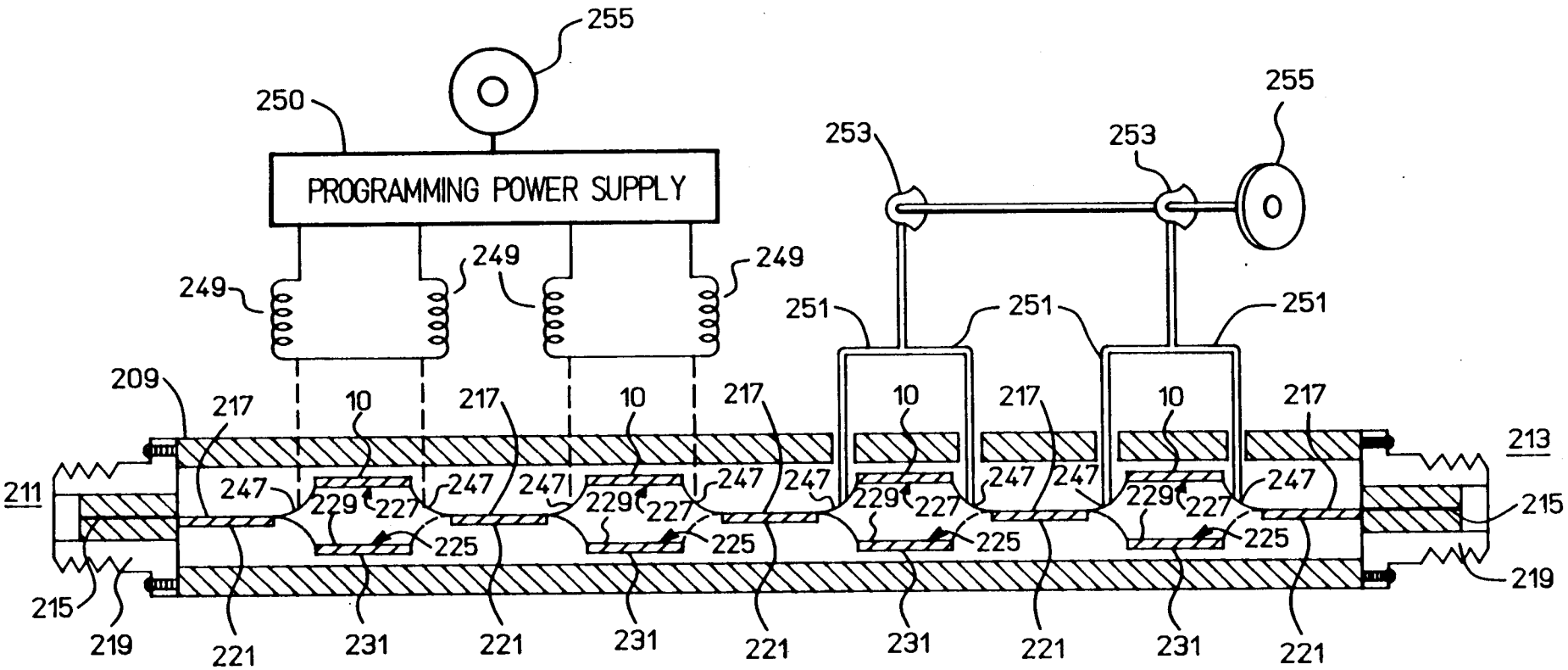
FIG. 4 shows a cascade attenuator incorporating the attenuator element shown in FIG. 2.

The attenuator element 10 in accordance with the invention can also be incorporated into a cascade attenuator, as shown in FIG. 4. Referring now to FIG. 4, there is shown a body 209 which forms the ground plane conductor of a strip line. Coaxial connectors 211, 213 at the ends of the body 209 each include a center conductor 215 which is matched coupled to a strip line conductor 217 and an outer conductor 219 which is connected to the body 209. The strip line conductor 217 is supported on a dielectric slab 221 which is mounted in longitudinal grooves in the side walls of the body 209.

At selected intervals along the length of the strip line conductor 217, a parallel pair of signal conductive elements 225 and 227 are disposed within the body 209 above and below the plane of the strip line conductor 217. The lower conductive element 225 forms a straight-through transmission path and includes a conductive strip line 229 supported by a dielectric slab 231 which is mounted in the longitudinal grooves in the side walls of the body 209. The width of the strip line 229 is decreased to maintain the characteristic impedance of the transmission line which is formed with closer spacing to the ground plane conductor. The upper conductive element 227 forms an attenuating transmission path and includes the attenuator elements 10 mounted in additional longitudinal grooves in the side walls of the body 209 and which is connected to the body 209 along its longitudinal edges.

The strip line conductor 217 includes a flexible portion 247 at each side of the parallel pair of signal transmission paths, which serves as a switching element. The switching element 247 is actuated either magnetically by suitable electromagnetic means 249 and programming power source 250 or mechanically by an actuator 251 and programming cam assembly 253. The actuator 251 may be any dielectric material which passes through an aperture in the body 209 that has dimensions which cause the aperture to operate as a waveguide beyond cutoff at the frequencies of signal applied to the attenuator so that signal leakage is negligible.

A selected step of attenuation is provided by switching the strip line conductor 247 at both ends of the parallel pair of signal transmission paths to the attenuator element 10 path. When a plurality of such paths are provided, each with an attenuator element 10 of selected value, such as 5 dB, 10 dB, 20 dB, and 40 dB, a number of attenuation steps in 5 dB increments from 5 dB to 75 dB may be provided by selectively switching in either an attenuation transmission path or a straight-through transmission path. This selection is provided in a conventional manner either by the programmed power supply 250 (used with the magnetic actuators) or the cam assembly 253 (used with the mechanical actuator 251) in response to the positions of an attenuation selector dial 255.

Figure 5A:
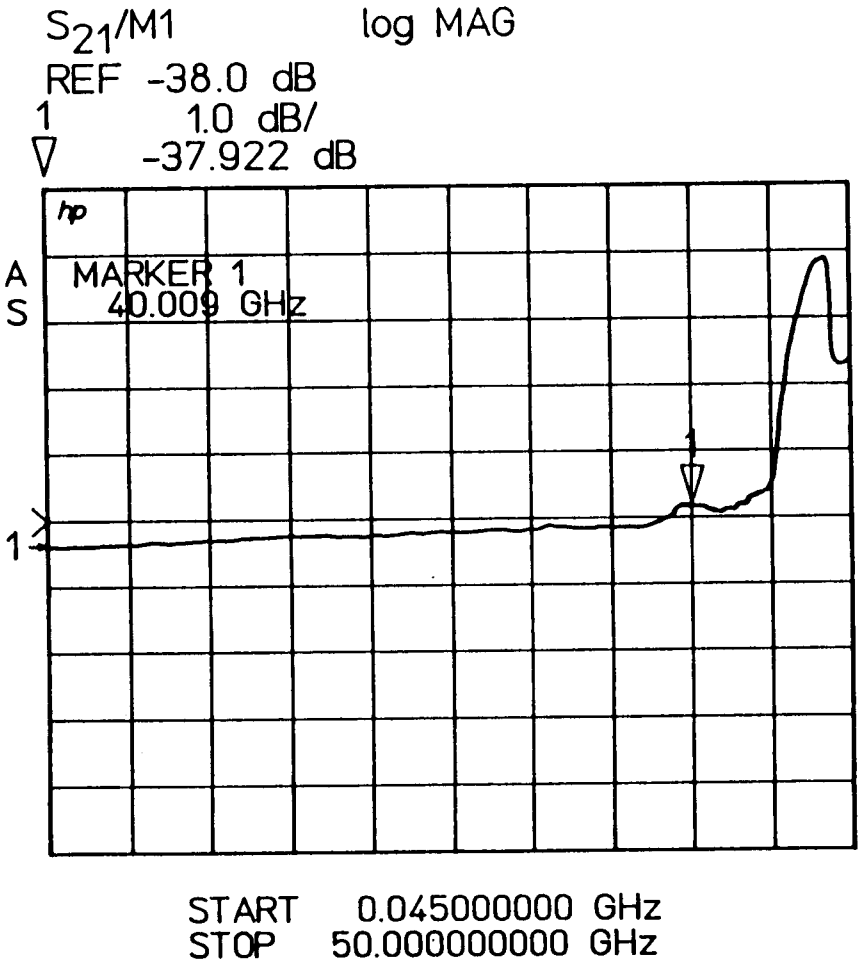
FIG 5A (PRIOR ART)
FIGS. 5A, 5B, and 5C, illustrates the frequency responses of a known cascade attenuator (FIG. 5A), the cascade attenuator shown in FIG. 4 with the tuning stubs adjusted to a maximum length (FIG. 5B), and the cascade attenuator shown in FIG. 4 with the tuning stubs adjusted to an optimum length (FIG. 5C).
Figure 5B:
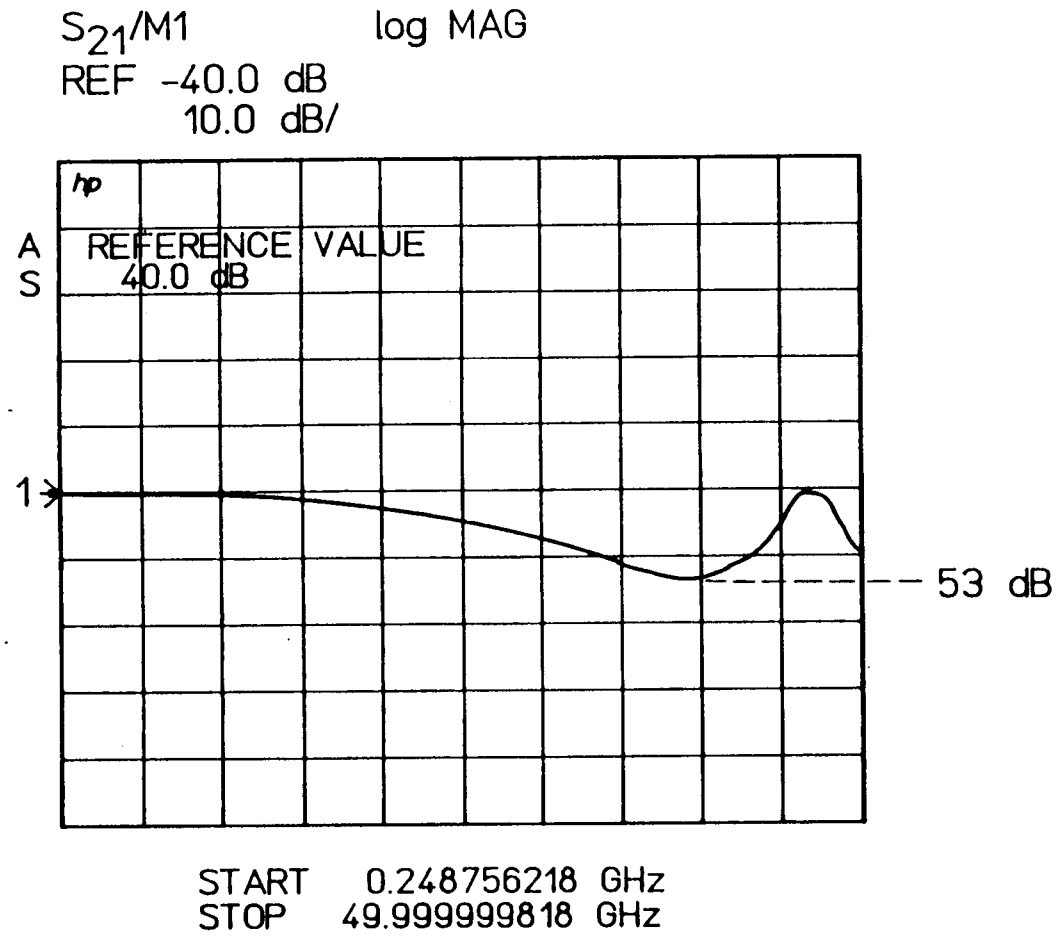
Figure 5C:
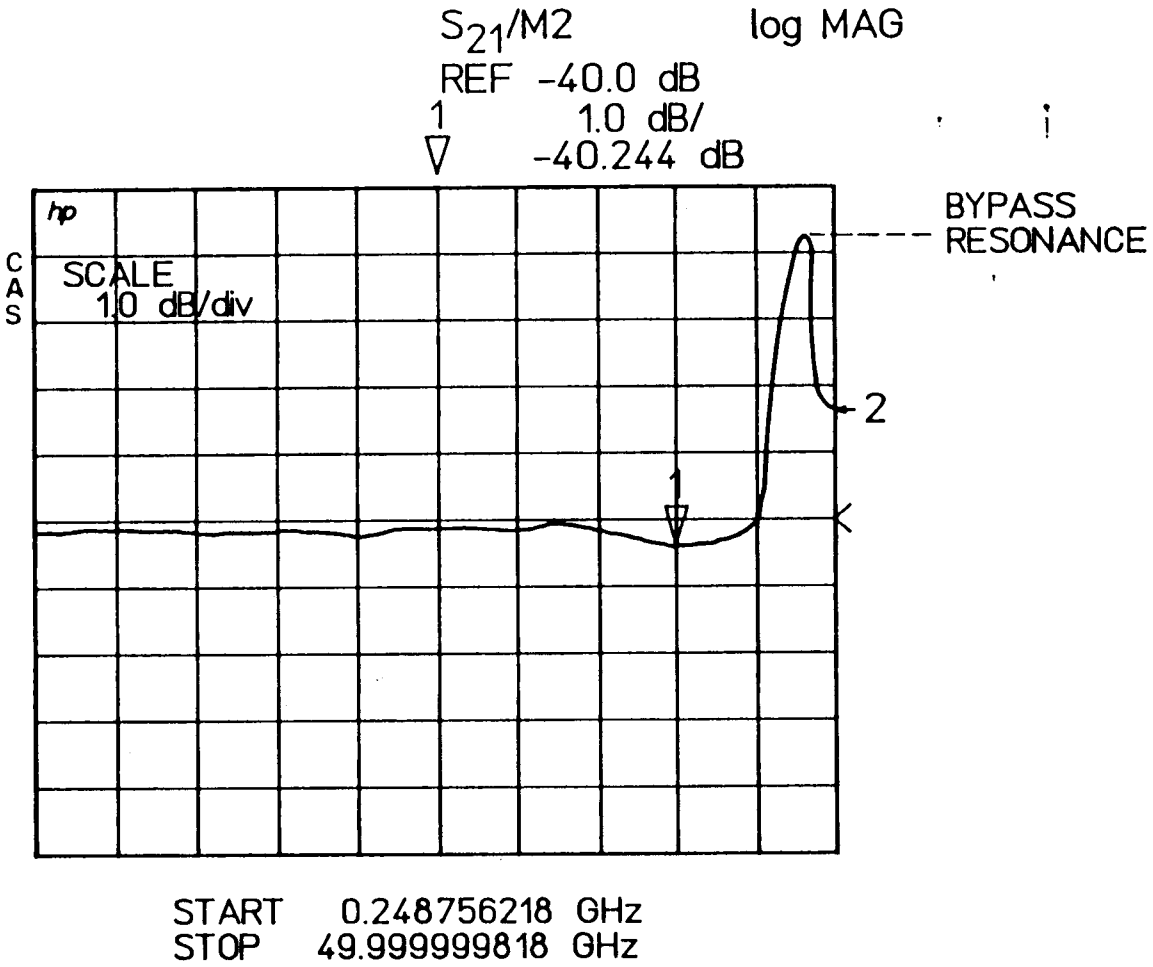

FIG. 5A illustrates the frequency response of a conventional cascade attenuator set at 40 dB. FIG. 5A evidences a decrease in attenuation with increasing frequency. FIG. 5B illustrates the frequency response of the cascade attenuator shown in FIG. 4 set at 40 dB with the attenuator elements 10 having tuning stubs 20 at a maximum length, such that the tuning stubs have a minimum clearance from the series portions 14A of the resistive film 14. FIG. 5B evidences reversal of the trend toward decreasing attenuation illustrated in FIG. 5A, such that attenuation can be increased with increasing frequency by providing the tuning stubs 20. Finally, FIG. 5C illustrates the frequency response of the cascade attenuator shown in FIG. 4 set at 40 dB with attenuator elements 10 having tuning stubs 20 at a length adjusted to provide an optimally flat response characteristic.

The foregoing description is offered primarily for purposes of illustration. While a variety of embodiments has been disclosed, it will be readily apparent to those skilled in the art that numerous other modifications and variations not mentioned above can still be made without departing from the spirit and scope of the invention as claimed below.

What is claimed is:

1. A resistive film attenuator element comprising:

a dielectric substrate;

a resistive film distributed ladder network disposed on the dielectric substrate; and at least one tuning stub disposed on the dielectric substrate in proximity to and spaced apart from the resistive film distributed ladder network, the at least one tuning stub and the resistive film distributed ladder network being in a coplanar structure, the at least one tuning stub having at least preselected dimension for adjusting a frequency response of the resistive film attenuator element in a predetermined frequency range to provide a desired frequency response characteristic.

2. The resistive film attenuator element of claim 1 wherein the at least one tuning stub is formed from the resistive film.

3. The resistive film attenuator element of claim 1 wherein the at least one tuning stub is formed from conductive material.

4. The resistive film attenuator element of claim 1 wherein the resistive film distributed ladder network comprises first resistive film portions each having a first end and a second end and second resistive film portions each having a first end and a second end and wherein respective ends of the first resistive film portions are connected together and to respective first contacts that are connected to respective inner coaxial contacts in a coaxial structure and wherein the first ends of the second resistive film portions are connected to respective second contacts that are connected to portions of an outer conductor of the coaxial structure and the second ends of the second resistive film portions are connected to respective first resistive film portions and wherein respective tuning stubs each have a first end and a second end and are disposed between adjacent second resistive film portions, the second ends of the tuning stubs extending away from the second contacts toward the first resistive film portions.

5. The resistive film attenuator element of claim 4 wherein the coaxial structure is a fixed coaxial line attenuator.

6. The resistive film attenuator element of claim 4 wherein the coaxial structure is a cascade attenuator.

7. The resistive film attenuator element of claim 4 wherein the frequency response of the attenuator element is adjusted by a predetermined length of the tuning stubs.

8. The resistive film attenuator element of claim 1 wherein the frequency response of the attenuator element is adjusted by a predetermined length of the at least one tuning stub.

9. In an electromagnetic wave energy transmission path including outer and inner conductors, a dielectric substrate supported within the outer conductor, a region of resistive material having two opposed boundaries and supported on the dielectric substrate, a first pair of electrodes spaced a first predetermined distance apart on the dielectric substrate connecting the outer conductor and two opposite boundaries of the resistive region along a length thereof, and a second pair of electrodes spaced a second predetermined distance apart on the dielectric substrate connecting the resistive region along a central portion thereof, the improvement comprising:

the resistive region being a resistive film distributed ladder network having resistive film patterned on the dielectric substrate, the resistive film distributed ladder network having first resistive film portions each having a first end and a second end and second resistive film portions each having a first end and a second end, respective ends of the first resistive film portions being connected together and to the second pair of electrodes, the first ends of the second resistive film portions being connected to the first pair of electrodes and the second ends of the second resistive film portions being connected to respective first resistive film portions; and tuning stubs each having a first end and a second end, respective tuning stubs being patterned on the dielectric substrate between adjacent second resistive film portions, the first ends of the tuning stubs being connected to the first pair of electrodes and the second ends of the tuning stubs extending away from a respective one of the first pair of electrodes toward the first resistive film portions.

10. The electromagnetic wave energy transmission path of claim 9 wherein the tuning stubs are formed from the resistive film.

11. The electromagnetic wave energy transmission path of claim 9 wherein the tuning stubs are formed from conductive material.

12. The electromagnetic wave energy transmission path of claim 9 wherein a frequency response is adjusted by a predetermined length of the tuning stubs.

13. In an electromagnetic wave energy transmission path for operation over a range of frequencies and including an outer conductor and sections of an inner conductor, an attenuator comprising:

a dielectric substrate disposed within the outer conductor and having at least one substantially flat surface, the surface having a lineal axis;

a region of resistive material on the surface along the lineal axis of the surface, the resistive region having opposed longitudinal boundaries;

a first pair of electrodes spaced apart on the dielectric substrate and connecting opposite longitudinal boundaries of the resistive region to the outer conductor; and a second pair of electrodes spaced apart on the surface of the dielectric substrate in a direction along the lineal axis and connecting the sections of the inner conductor to the resistive region along central portions of the lateral boundaries of the resistive region intermediate the longitudinal boundaries thereof;

the resistive region being a resistive film distributed ladder network having resistive film patterned on the dielectric substrate, the resistive film distributed ladder network having first resistive film portions each having a first end and a second end and second resistive film portions each having a first end and a second end, respective ends of the first resistive film portions being connected together and to the second pair of electrodes, the first ends of the second resistive film portions being connected to the first pair of electrodes and the second ends of the second resistive film portions being connected to respective first resistive film portions; and tuning stubs each having a first end and a second end, respective tuning stubs being patterned on the dielectric substrate between adjacent second resistive film portions, the first ends of the tuning stubs being connected to the first pair of electrodes and the second ends of the tuning stubs extending away from a respective one of the first pair of electrodes toward the first resistive film portions.

14. The attenuator of claim 13 wherein the tuning stubs are formed from the resistive film.

15. The attenuator of claim 13 wherein the tuning stubs are formed from conductive material.

16. The attenuator of claim 13 wherein a frequency response is adjusted by a predetermined length of the tuning stubs.

17. Signal apparatus comprising:

a transmission line including a ground plane conductor;

a first signal transmission path of the transmission line within the ground plane conductor having a first end and a second end and including a resistive film on a dielectric substrate, the resistive film being a distributed ladder network having resistive film patterned on the dielectric substrate, the resistive film distributed ladder network having first resistive film portions each having a first end and a second end and second resistive film portions each having a first end and a second end, respective ends of the first resistive film portions being connected together and also connected between a first pair of electrodes, the first ends of the second resistive film portions being connected to a second pair of electrodes and the second ends of the second resistive film portions being connected to respective first resistive film portions;

tuning stubs each having a first end and a second end, respective tuning stubs being patterned on the dielectric substrate between adjacent second resistive film portions, the first ends of the tuning stubs being connected to the second pair of electrodes and the second ends of the tuning stubs extending away from a respective one of the first pair of electrodes toward the first resistive film portions;

means connecting the ground plane conductor and the second pair of electrodes;

a second signal transmission path within the ground plane conductor in spaced plane-parallel relation to the resistive film on the dielectric substrate in the first signal transmission path, the second signal transmission path having a first end and a second end;

a signal conductor at each end of the first and second signal transmission paths disposed intermediate the spacing thereof and within the ground plane conductor, the signal conductor having a first end and a second end;

a switching element at each end of the signal conductor adjacent the first and second signal transmission paths forming a portion of the length of the signal conductor; and actuator means for simultaneously deflecting the switching elements to one of the first and second signal transmission paths.

18. The signal apparatus of claim 17 wherein the tuning stubs are formed from the resistive film.

19. The signal apparatus of claim 17 wherein the tuning stubs are formed from conductive material.

20. The signal apparatus of claim 17 wherein a frequency response is adjusted by a predetermined length of the tuning stubs.

* * * * *